US012577953B2

(12) United States Patent
Bonnefoi et al.

(10) Patent No.: US 12,577,953 B2
(45) Date of Patent: Mar. 17, 2026

(54) SCROLL COMPRESSOR INCLUDING A DISCHARGE CHECK VALVE ASSEMBLY WITH METAL-TO-METAL SEALING SURFACES

(71) Applicants: Danfoss Commercial Compressors, Reyrieux (FR); Danfoss A/S, Nordborg (DK)

(72) Inventors: Patrice Bonnefoi, Nordborg (DK); Jean-Jacques Laissus, Reyrieux (FR); Gabriel Streda, Nordborg (DK); Yves Rosson, Villars les Dombes (FR); Julien Lavy, Béligneux (FR); Sebastien Sababady, Villefranche-sur-Saône (FR)

(73) Assignees: DANFOSS COMMERCIAL COMPRESSORS, Trevoux (FR); DANFOSS A/S, Nordborg (DK)

( * ) Notice: Subject to any disclaimer, the term of this patent is extended or adjusted under 35 U.S.C. 154(b) by 0 days.

(21) Appl. No.: 18/992,835

(22) PCT Filed: Jun. 30, 2023

(86) PCT No.: PCT/EP2023/068017
§ 371 (c)(1),
(2) Date: Jan. 9, 2025

(87) PCT Pub. No.: WO2024/012896
PCT Pub. Date: Jan. 18, 2024

(65) Prior Publication Data

US 2026/0016014 A1 Jan. 15, 2026

(30) Foreign Application Priority Data

Jul. 11, 2022 (FR) ..... 2207079

(51) Int. Cl.
*F04C 29/12* (2006.01)
*F04C 18/02* (2006.01)

(52) U.S. Cl.
CPC ..... *F04C 29/126* (2013.01); *F04C 18/0215* (2013.01)

(58) Field of Classification Search
CPC ..... F04C 29/126; F04C 18/0215
See application file for complete search history.

(56) References Cited

U.S. PATENT DOCUMENTS 6,132,191 A 10/2000 Hugenroth et al.
7,721,757 B2 5/2010 Ginies et al.
(Continued)

FOREIGN PATENT DOCUMENTS

BE 686193 A 2/1967
FR 3116581 A1 5/2022
(Continued)

OTHER PUBLICATIONS

International Search Report mailed Oct. 11, 2023, in connection with corresponding International Application No. PCT/EP2023/068017; 4 pages.

*Primary Examiner* — Shafiq Mian
(74) *Attorney, Agent, or Firm* — McCormick, Paulding & Huber PLLC

(57) ABSTRACT

A scroll compressor includes a compressor shell (2) having a discharge outlet (4), and a discharge check valve assembly (18) including a valve housing (21) arranged at the discharge outlet (4) and provided with a metal valve seat (24), and a valve member (26) movable between a closed position and an open position. The metal valve seat (24) has a frusto-conical or toroidal sealing surface (25) and the valve member (26) has a metal sealing surface (36) being configured to cooperate with the frusto-conical or toroidal sealing surface (25) when the valve member (26) is in the closed position,
(Continued)

the metal valve seat (24) and the valve member (26) being configured to define a linear sealing contact between the metal sealing surface (36) of the valve member (26) and the frusto-conical or toroidal sealing surface (25) of the metal valve seat (24). The valve member (26) includes a valve stem portion (33) and a valve head portion (35) connected to the valve stem portion (33). The valve stem portion (33) includes a stem end portion (41) which is remote from the valve head portion (35). The stem end portion (41) includes a tool fixing member (42) configured to allow temporary fixing of a tooling, adapted to displace the valve member (26) in the open position during assembly process of the scroll compressor (1), to the stem end portion (41).

12 Claims, 4 Drawing Sheets

(56) References Cited

U.S. PATENT DOCUMENTS

| | | | | |
|---|---|---|---|---|
| 9,506,470 | B2 | 11/2016 | Ginies et al. | |
| 2003/0118464 | A1* | 6/2003 | Genevois | F04C 29/126 418/270 |
| 2022/0170466 | A1* | 6/2022 | Lavy | F04C 29/126 |

FOREIGN PATENT DOCUMENTS

| | | | |
|---|---|---|---|
| FR | 3116868 | A1 | 6/2022 |
| JP | H08-319973 | A | 12/1996 |
| WO | 2022112341 | A1 | 6/2022 |

* cited by examiner

[Fig 1]
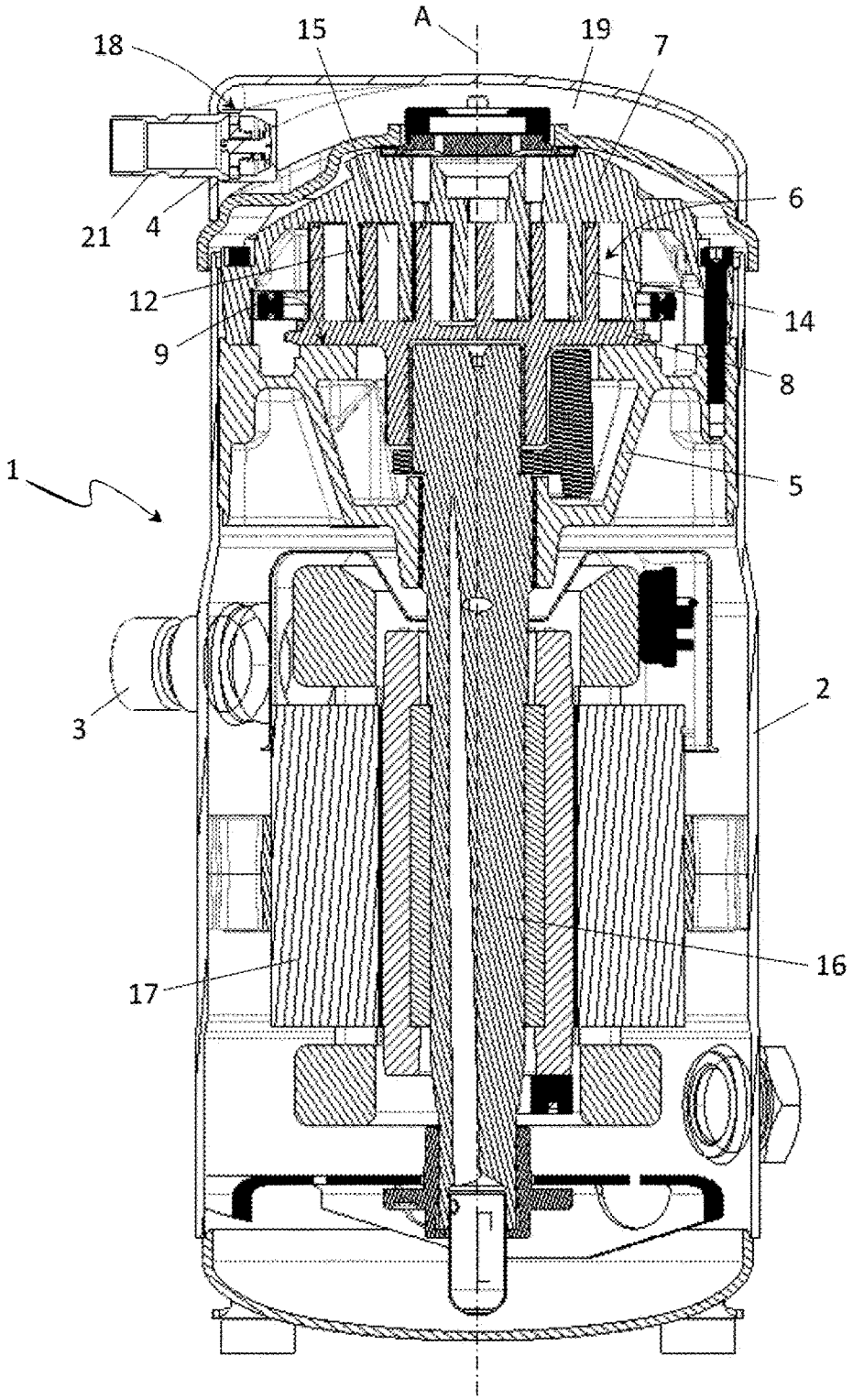

[Fig 2]
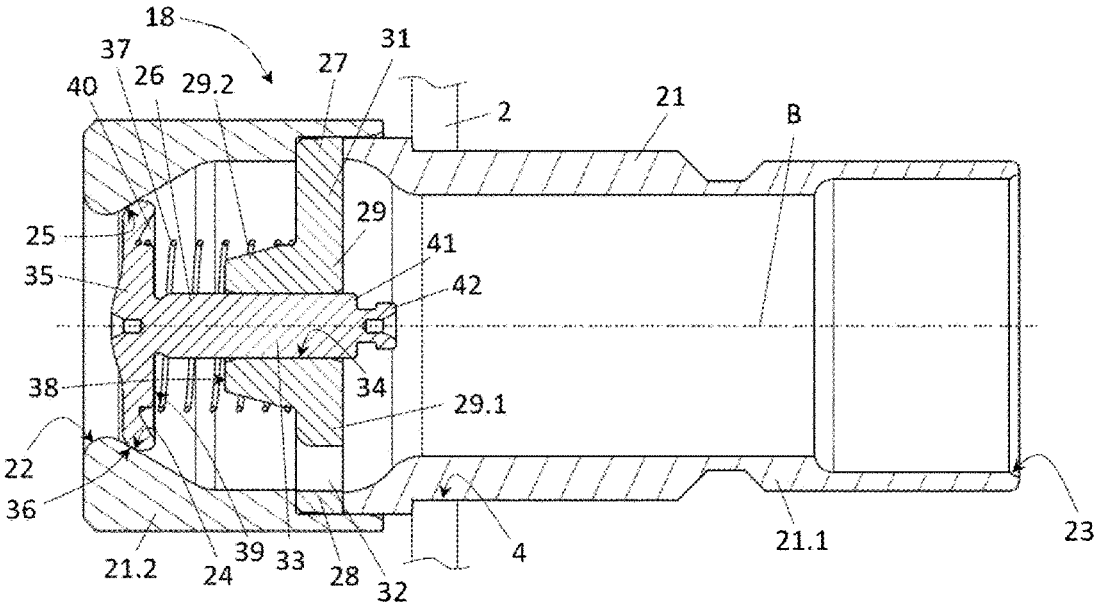
[Fig 3]
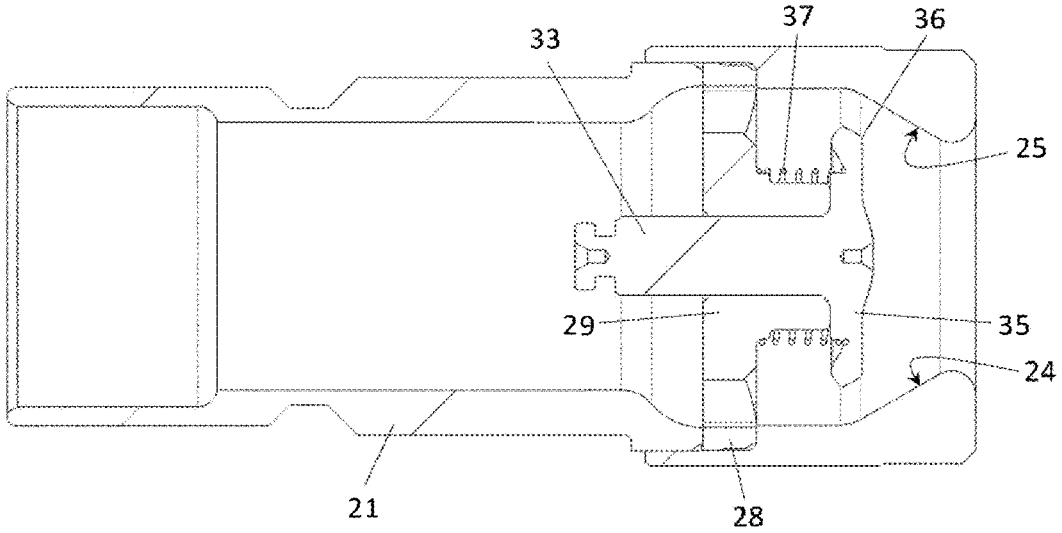

[Fig 4]
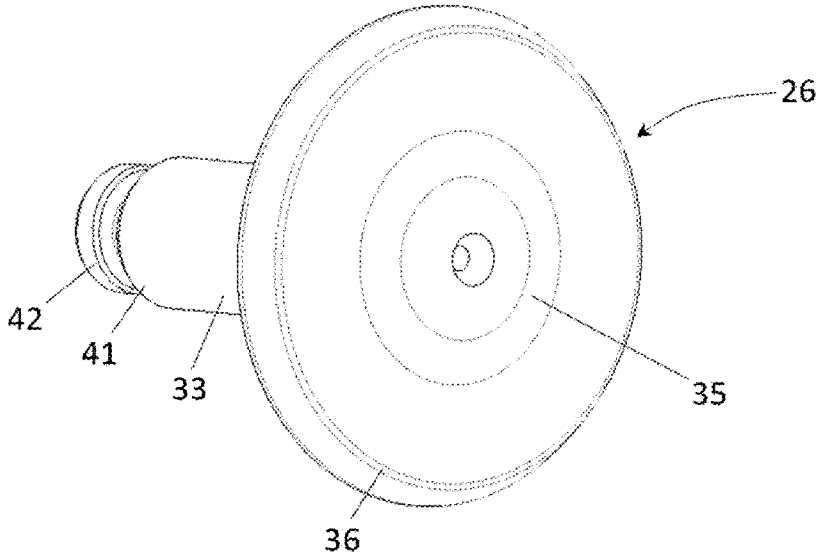
[Fig 5]
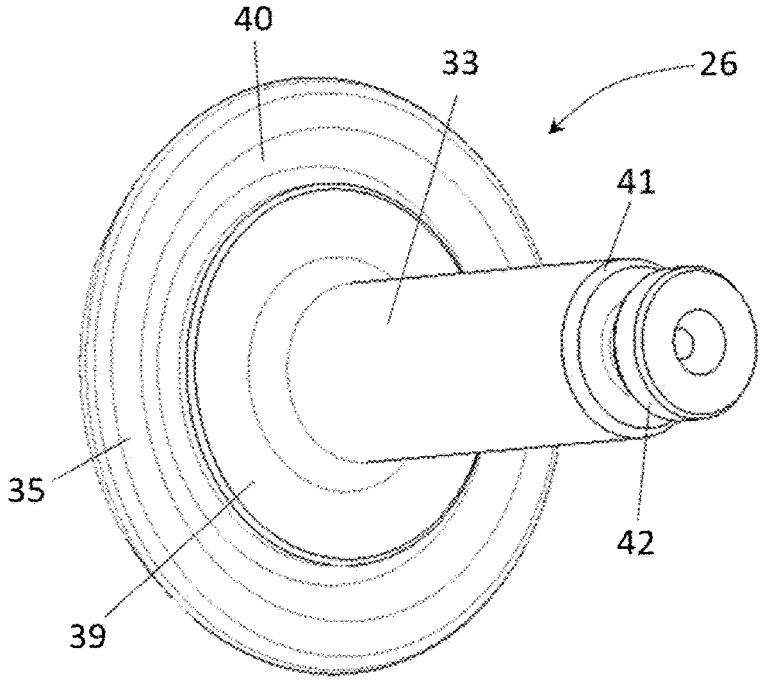

[Fig 6]
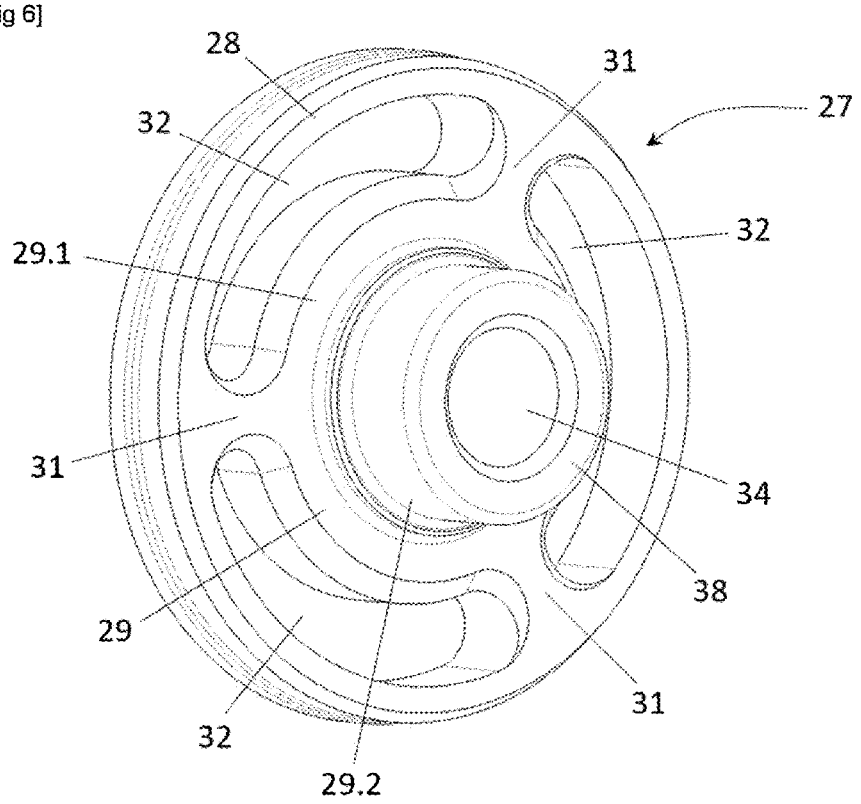

SCROLL COMPRESSOR INCLUDING A DISCHARGE CHECK VALVE ASSEMBLY WITH METAL-TO-METAL SEALING SURFACES

CROSS-REFERENCE TO RELATED APPLICATIONS

This application is a National Stage application of International Patent Application No. PCT/EP2023/068017, filed on Jun. 30, 2023, which claims priority to French Patent Application No. FR2207079, filed on Jul. 11, 2022, each of which is hereby incorporated by reference in its entirety.

TECHNICAL FIELD

The invention relates to a scroll compressor including an improved discharge check valve assembly, also named discharge non-return valve assembly, arranged at a discharge outlet of the scroll compressor and secured to the compressor shell of the scroll compressor. Such a discharge check valve assembly controls the communication between a discharge chamber of the scroll compressor and a piping of a refrigeration system. When the scroll compressor is operating, the compressed gas will open the normally closed valve to enable discharge of the compressed gas into the refrigeration system. When the compressor stops, a spring biased valve member will be urged towards a valve seat and close the valve to prevent backflow of high pressure refrigerant gas from the refrigeration system into the discharge chamber of the scroll compressor. Hereby, eventual reverse movement of scroll elements of the scroll compressor can be avoided, and re-start of the scroll compressor is eased due to the decoupling of the scroll compressor from the system pressure.

BACKGROUND

U.S. Pat. No. 7,721,757B2 show a discharge check valve assembly for use in a scroll compressor, where a piston element comprising a PTFE sealing member cooperates with an annular metal valve seat having a rounded contact surface. Such discharge check valve assemblies have very low leakage rates due to the relatively soft polymer sealing material, which however is subjected to wear. Leakage will therefore increase along the operating lifetime of the scroll compressor.

U.S. Pat. No. 9,506,470B2 discloses a scroll compressor with a discharge check valve attached to the hermetic compressor shell. The discharge check valve comprises a floating disc-shaped metal valve member cooperating with an annular metal valve seat having a flat contact surface. Such discharge check valves have improved wear resistance, but at the same time increased leakage rates compared to valve members comprising sealing gaskets.

SUMMARY

It is an object of the present invention to provide a scroll compressor with a discharge check valve assembly which can overcome the drawbacks encountered in conventional scroll compressors.

Another object of the present invention is to provide a scroll compressor with a discharge check having improved sealing properties over the entire operating lifetime of the scroll compressor.

According to the invention such a scroll compressor comprises a compressor shell having a discharge outlet, and a discharge check valve assembly including:

- a valve housing arranged at the discharge outlet of the compressor shell and being hermetically secured to the compressor shell, the valve housing including a metal valve seat,
- a valve member arranged within the valve housing and movable between a closed position in which the valve member bears against the metal valve seat and an open position in which the valve member is remote from the metal valve seat,
- wherein the metal valve seat has a frusto-conical or toroidal sealing surface and the valve member has a metal sealing surface being configured to cooperate with the frusto-conical or toroidal sealing surface when the valve member is in the closed position, the metal valve seat and the valve member being configured to define a linear sealing contact between the metal sealing surface of the valve member and the frusto-conical or toroidal sealing surface of the metal valve seat when the valve member is in the closed position.

Such a configuration of the valve member and the metal valve seat leads to high contact pressure at the sealing area between the valve member and the metal valve and thus to good sealing properties. Further, the metal-to-metal sealing surfaces ensure less wear and increased lifetime of the discharge check valve assembly.

The scroll compressor may also include one or more of the following features, taken alone or in combination.

According to an embodiment of the invention, the linear sealing contact is annular.

According to an embodiment of the invention, the valve housing includes an inlet opening fluidly connected to a discharge chamber of the scroll compressor, and an outlet opening configured to be fluidly connected to a refrigerant system, such as a refrigeration or cooling system. Advantageously, the metal valve seat extends around the inlet opening.

According to an embodiment of the invention, the valve housing has a first end portion arranged inside the compressor shell and a second end portion arranged outside the compressor shell and configured to be connected to a refrigerant system.

According to an embodiment of the invention, the valve housing is tubular.

According to an embodiment of the invention, the metal sealing surface of the valve member has a spherical segment shape, i.e. a frusto-spherical shape, or is a toric surface, i.e. a toroidal surface of revolution.

According to an embodiment of the invention, the metal sealing surface has a radius between 1 and 30 mm, advantageously between 10 and 20 mm.

According to an embodiment of the invention, the frusto-conical or toroidal sealing surface has a cone half-angle between 20 and 40 degrees, advantageously between 25 and 35 degrees.

According to an embodiment of the invention, the discharge check valve assembly further includes a support member arranged within the tubular valve housing and configured to support the valve member and to guide the valve member between the closed and open positions.

According to an embodiment of the invention, the support member includes a first axial stop surface and the valve member includes a second axial stop surface configured to abut against the first axial stop surface when the valve member is in the open position.

According to an embodiment of the invention, the support member comprises a ring-shaped attachment portion fixed to the valve housing and a central support portion configured to support the valve member and to guide the valve member between the closed and open positions.

According to an embodiment of the invention, the central support portion is located opposite the metal valve seat relative to the valve member.

According to an embodiment of the invention, the central support portion includes a first support part remote from the metal valve seat and having a disc-shape, and a second support part directed towards the metal valve seat and having an outer surface which tapers towards the metal valve seat. Advantageously, the outer surface of the second support part is frusto-conical.

According to an embodiment of the invention, the ring-shaped attachment portion and the central support portion of the support member are connected to each other by a plurality of connecting arms, e.g. by three connecting arms, partially defining a plurality of flow openings for a refrigerant gas.

According to an embodiment of the invention, each connecting arm protrudes, for example radially, from an outer surface of the central support portion.

According to an embodiment of the invention, the valve member comprises a valve stem portion and a valve head portion connected to the valve stem portion, the metal sealing surface being formed at a radial outer portion of the valve head portion.

According to an embodiment of the invention, the valve head portion of the valve member is formed at an end of the valve stem portion directed towards the metal valve seat.

According to an embodiment of the invention, the ring-shaped attachment portion and the central support portion of the support member are concentrically arranged.

According to an embodiment of the invention, the valve stem portion is slidably mounted on the support member, and for example on the central support portion.

According to an embodiment of the invention, the valve stem portion includes a stem end portion which is remote from the valve head portion and which is configured to protrude from the central support portion when the valve member is in the closed position.

According to an embodiment of the invention, the stem end portion includes a tool fixing member, for example provided with a radial annular groove, configured to allow temporary fixing of a tooling, adapted to displace the valve member in the open position during assembly process of the scroll compressor, to the stem end portion. For example, high pressure tests have to be performed after welding of the compressor shell, which means after welding of the valve housing into the discharge outlet of the compressor shell. To allow introduction of test gas into the high pressure volume of the scroll compressor, the valve member has to be brought into its open position. The provision of the tool fixing member on the valve stem portion allows a temporary fixing of a tooling, such as a gripping tool, to the valve stem portion in order to then displace the valve member in the open position by exerting a pulling force on the valve stem portion in an axial direction. For example, the gripping tool may be provided with an elastic snapping element configured to snap when pushed against the tool fixing member in an axial direction.

According to an embodiment of the invention, the central support portion of the support member includes a central opening, for example a central bore, accommodating the valve stem portion of the valve member.

According to an embodiment of the invention, the discharge check valve assembly further includes an elastic element, e.g. a spring member, arranged between the valve head portion of the valve member and a surface of the central support portion of the support member directed towards the valve head portion, the elastic element being configured to urge the valve member into contact with the metal valve seat, when the scroll compressor is stopped.

According to an embodiment of the invention, the valve head portion comprises an annular groove partially accommodating the elastic element.

According to an embodiment of the invention, the valve head portion has a globally plate-shape and extends perpendicular to the valve stem portion.

According to an embodiment of the invention, the central support portion of the support member has a maximal outer diameter which is at least 90% of a maximal outer diameter of the valve head portion of the valve member. Hereby, the support member is shielding the valve member for reverse flow of refrigerant gas towards the scroll compressor. This reduces gas forces and closing impact on the valve member, and thus improves the relatability of the discharge check valve assembly of the present invention.

According to an embodiment of the invention, the valve housing comprises a first tubular housing part inserted into the discharge outlet of the scroll compressor and secured to the compressor shell, the first tubular housing part having a first end portion protruding into the compressor shell and a second end portion arranged outside the compressor shell and configured to be connected to piping of a refrigeration system, a major part of the first tubular housing part extending outside the scroll compressor, for example at least 70% of the length of the first tubular housing part extending outside the scroll compressor.

According to an embodiment of the invention, the valve housing further comprises a second tubular housing part arranged inside the compressor shell, the second tubular housing part having a first end portion and a second end portion, the metal valve seat being formed adjacent, and for example on, the first end portion of the second tubular housing part and the second end portion of the second tubular housing cooperating with and being secured to the first end portion of the first tubular housing part at a predetermined distance from the compressor shell.

According to an embodiment of the invention, the first and second tubular housing parts are secured to each other by laser welding, which minimizes any deformations of the first and second tubular housing parts or the support member.

According to an embodiment of the invention, the ring-shaped attachment portion of the support member is positioned and clamped between the first and second tubular housing parts.

According to an embodiment of the invention, the discharge check valve assembly is configured to prevent backflow of refrigerant from a high pressure side of the refrigerant system into the compressor shell, and particularly into a discharge chamber of the scroll compressor.

According to an embodiment of the invention, the valve housing and the support member are coaxially arranged.

According to an embodiment of the invention, the support member is made in one piece.

According to an embodiment of the invention, the valve member is made in one piece.

BRIEF DESCRIPTION OF THE DRAWINGS

The following detailed description of one embodiment of the invention is better understood when read in conjunction with the appended drawings being understood, however, that the invention is not limited to the specific embodiment disclosed.

FIG. 1 is a longitudinal section view of a scroll compressor according to an embodiment of the invention.

FIG. 2 is a partial longitudinal section view of the scroll compressor of FIG. 1 showing a discharge check valve assembly in a closed position.

FIG. 3 is a longitudinal section view of the discharge check valve assembly in an open position.

FIG. 4 is a front perspective view of a valve member of the discharge check valve assembly.

FIG. 5 is a rear perspective view of the valve member of FIG. 4.

FIG. 6 is a perspective view of a support member of the discharge check valve assembly.

DETAILED DESCRIPTION

FIG. 1 describes a scroll compressor 1, and for example a refrigeration scroll compressor, according to an embodiment of the invention occupying a vertical position.

The scroll compressor 1 includes a compressor shell 2 provided with a suction inlet 3 configured to supply the scroll compressor 1 with refrigerant to be compressed, and with a discharge outlet 4 configured to discharge compressed refrigerant. The discharge outlet 4 is advantageously provided on an upper cap of the compressor shell 2.

The scroll compressor 1 further includes a support arrangement 5 fixed to the compressor shell 2, and a compression unit 6 disposed inside the compressor shell 2 and supported by the support arrangement 5. The compression unit 6 is configured to compress the refrigerant supplied by the suction inlet 3. The compression unit 6 includes a fixed scroll 7, which is fixed in relation to the compressor shell 2, and an orbiting scroll 8 supported by and in slidable contact with a thrust bearing surface 9 provided on the support arrangement 5.

As known, the fixed scroll 7 includes a fixed spiral wrap 12, and the orbiting scroll 8 includes an orbiting spiral wrap 14 meshing with the fixed spiral wrap 12 of the fixed scroll 7 to form a plurality of compression chambers 15 between them. Each of the compression chambers 15 has a variable volume which decreases from the outside towards the inside, when the orbiting scroll 8 is driven to orbit relative to the fixed scroll 7.

Furthermore, the scroll compressor 1 includes a drive shaft 16 which extends vertically and which is configured to drive the orbiting scroll 8 in an orbital movement, and an electric driving motor 17 coupled to the drive shaft 16 and configured to drive in rotation the drive shaft 16 about a rotation axis A.

The scroll compressor 1 further includes a discharge check valve assembly 18 arranged in the discharge outlet 4 and fluidly connected to a discharge chamber 19 at least partially defined by the compressor shell 2. The discharge check valve assembly 18 is particularly configured to prevent backflow of refrigerant from a high pressure side of a refrigerant system, such as a refrigeration or cooling system, into the discharge chamber 19 and into the compression chambers 15.

The discharge check valve assembly 18 includes a valve housing 21 arranged at the discharge outlet 4 of the compressor shell 2 and hermetically secured to the discharge outlet 4. The valve housing 21 is tubular and has a first end portion arranged inside the discharge chamber 19 and provided with an inlet opening 22 emerging into the discharge chamber 19, and a second end portion arranged outside the compressor shell 2 and provided with an outlet opening 23 configured to be fluidly connected to the refrigerant system. Particularly, the second end portion of the valve housing 21 acts as a fitting to connect an external tubing of the refrigerant system.

According to the embodiment shown on the figures, the valve housing 21 comprises a first tubular housing part 21.1 inserted into the discharge outlet 4 and secured to the compressor shell 2. The first tubular housing part 21.1 has a first end portion protruding into the compressor shell 2 and a second end portion arranged outside the compressor shell 2 and configured to be connected to an external tubing of the refrigeration system. Advantageously, a major part of the first tubular housing part 21.1 extends outside the scroll compressor 1. For example at least 70% of the length of the first tubular housing part 21.1 extending outside the scroll compressor 1.

The valve housing 21 further comprises a second tubular housing part 21.2 arranged inside the compressor shell 2. The second tubular housing part 21.2 has a first end portion defining the inlet opening 22 and a second end portion cooperating with and being secured to the first end portion of the first tubular housing part 21.1 at a predetermined distance from the compressor shell 2. Advantageously, the first and second tubular housing parts 21.1, 21.2 are secured to each other by laser welding, which minimizes any deformations of the first and second tubular housing parts 21.1, 21.2.

The discharge check valve assembly 18 further includes a metal valve seat 24 located within the valve housing 21 and formed at an inner surface of the second tubular housing part 21.2. Advantageously, the metal valve seat 24 is adjacent the first end portion of the second tubular housing part 21.2.

The metal valve seat 24 is annular and extends around the inlet opening 22, and has a frusto-conical sealing surface 25. The frusto-conical sealing surface 25 has a cone half-angle between 20 and 40 degrees, advantageously between 25 and 35 degrees. According to another embodiment of the invention, metal valve seat 24 may have a toroidal sealing surface 25, and particularly a concave toroidal sealing surface.

The discharge check valve assembly 18 also includes a valve member 26 arranged within the valve housing 21 and movable between a closed position (see FIG. 2) in which the valve member 26 bears against the metal valve seat 24 and an open position (see FIG. 3) in which the valve member 26 is remote from the metal valve seat 24. According to the embodiment shown on the figures, the valve member 26 is made in one piece.

Furthermore, the discharge check valve assembly 18 includes a support member 27 made in one piece and arranged within the valve housing 21 coaxially to the valve member 26 and the valve housing 21.

The support member 27 comprises a ring-shaped attachment portion 28 fixed to an inner surface of the valve housing 21. The ring-shaped attachment portion 28 may be snapped, press-fitted, glued or secured by a retaining element to the inner surface of the valve housing 21. According to the embodiment shown on the figures, the ring-shaped attachment portion 28 is positioned and clamped between the first and second tubular housing parts 21.1, 21.2.

The support member 27 further comprises a central support portion 29 concentrically arranged with the ring-shaped attachment portion 28, and configured to support the valve member 26 and to guide the valve member 26 between the closed and open positions. The central support portion 29 is located opposite the metal valve seat 24 relative to the valve member 26, and is connected to the ring-shaped attachment portion 28 by several connecting arms 31, for example three connecting arms 31, protruding, for example radially, from an outer surface of the central support portion 29 and distributed around a central longitudinal axis B of the valve housing 21. The ring-shaped attachment portion 28, the central support portion 29 and the connecting arms 31 define a plurality of flow openings 32 for a refrigerant gas.

According to the embodiment shown on the figures, the central support portion 29 includes a first support part 29.1 remote from the metal valve seat 24 and having a disc-shape, and a second support part 29.2 directed towards the metal valve seat 24 and having an outer surface which tapers towards the metal valve seat 24. The outer surface of the second support part 29.2 may for example be frusto-conical. Advantageously, the second support part 29.2 has a maximal outer diameter which is smaller than the maximal outer diameter of the first support part 29.1.

As better shown on FIGS. 2 and 4, the valve member 26 comprises a valve stem portion 33 slidably mounted in a central bore 34 provided on the central support portion 29. Advantageously, the valve stem portion 33 and the central support portion 29 extend coaxially to the central longitudinal axis B of the valve housing 21.

The valve member 26 further comprises a valve head portion 35 which is formed at an end of the valve stem portion 33 directed towards the metal valve seat 24 and which is configured to cooperate with the metal valve seat 24 when the valve member 26 is in the closed position. Advantageously, the valve head portion 35 has a globally plate-shape and extends perpendicular to the valve stem portion 33.

According to the embodiment shown on the figures, the central support portion 29 has a maximal outer diameter which is at least 90% of a maximal outer diameter of the valve head portion 35. Hereby, the support member 27 is shielding the valve member 26, and particularly the valve head portion 35, for reverse flow of refrigerant gas towards the scroll compressor 1. This reduces gas forces and closing impact on the valve member 26.

The valve member 26 has a metal sealing surface 36 formed at a radial outer portion of the valve head portion 35 and configured to cooperate with the frusto-conical sealing surface 25 of the metal valve seat 24 when the valve member 26 is in the closed position. Particularly, the metal valve seat 24 and the valve member 26 are configured to define a linear sealing contact between the metal sealing surface 36 of the valve member 26 and the frusto-conical sealing surface 25 of the metal valve seat 24 when the valve member 26 is in the closed position. Advantageously, said linear sealing contact is annular and extends coaxially to the central longitudinal axis B of the valve housing 21.

The metal sealing surface 36 of the valve member 26 may have a spherical segment shape, and particularly a convex spherical segment shape, or may be a toric surface, and particularly a convex toric surface. Advantageously, the metal sealing surface 36 has a radius between 1 and 30 mm, and for example between 10 and 20 mm. When the metal sealing surface 36 has a spherical segment shape, said radius is the radius of the sphere defining the spherical segment shape, and when the metal sealing surface 36 is a toric surface, said radius is the minor radius of the torus defining the toric surface.

The discharge check valve assembly 18 further comprises an elastic element 37, such as a spring member, arranged between the valve head portion 35 of the valve member 26 and a surface of the central support portion 29 directed towards the valve head portion 35. The elastic element 37 is configured to urge the valve member 26 into contact with the metal valve seat 24, i.e. towards the closed position, when the scroll compressor 1 is stopped. According to the embodiment shown on the figures, the valve head portion 35 comprises an annular groove 40 accommodating an end portion of the elastic element 37.

As better shown on FIGS. 2 and 3, the central support portion 29 includes a first axial stop surface 38 located at an end face of the central support portion 29 directed towards the metal valve seat 24, and the valve head portion 35 includes a second axial stop surface 39 configured to abut against the first axial stop surface 38 when the valve member 26 is in the open position.

According to the embodiment shown on the figures, the valve stem portion 33 includes a stem end portion 41 which is remote from the valve head portion 35 and which is configured to protrude from an end face of the central support portion 29, facing away from the valve head member, when the valve member 26 is in the closed position. Advantageously, the stem end portion 41 includes a tool fixing member 42, for example provided with a radial annular groove, configured to allow temporary fixing of a gripping tool (not shown on the figures) adapted to displace the valve member 26 in the open position during assembly process of the scroll compressor 1.

For example, high pressure tests have to be performed after welding of the compressor shell 2, which means after welding of the valve housing 21 into the discharge outlet 4 of the compressor shell 2. To allow introduction of test gas into the high pressure volume of the scroll compressor 1, the valve member 26 has to be brought into its open position. The provision of the tool fixing member 42 on the valve stem portion 33 allows a temporary fixing of the gripping tool to the valve stem portion 33 in order to then displace the valve member 26 in the open position by exerting a pulling force on the valve stem portion 33 in an axial direction. For example, the gripping tool may be provided with an elastic snapping element configured to snap when pushed against the tool fixing member 42 in an axial direction.

To grip the tool fixing member 42 provided on the valve stem portion 33, a shaft of the gripping tool comprising a radially flexible end portion is inserted into the valve housing 21 from the second end portion thereof. The gripping tool further comprises a guiding part inserted into the valve housing 21 and abutting an axial step formed in the valve housing 21. The shaft of the gripping tool is slidingly arranged in a central bore of the guiding part. With the shaft being snapped to the valve stem portion 33, it can be pulled in a direction towards the outside of the scroll compressor 1 to bring the valve member 26 in its open position. Applying a further pulling force will elastically deform the flexible end portion of the shaft to release the elastic snapping element from the radial annular groove of the valve stem portion 33. Now, the gripping tool can be removed from the valve housing 21 and the valve member 26 will return to its closed position due to the elastic element 37.

The operation of the scroll compressor 1 will now be described.

When the scroll compressor 1 according to the invention is turned on, the orbiting scroll 8 is driven by the drive shaft 16 following an orbital movement, this movement of the orbiting scroll 8 causing an intake and compression of refrigerant in the compression chambers 15. The compressed refrigerant exits toward the discharge chamber 19 via a discharge conduit formed in the central portion of the fixed scroll 7, flows into the discharge chamber 19 and through the inlet opening 22 of the valve housing 21, moves the valve member 26 into the open position against the biasing force exerted by the elastic element 37, and then flows through the flow openings 32 and the outlet opening 23 of the valve housing 21.

When the scroll compressor 1 according to the invention is stopped, the elastic element 37 urges the valve member 26 toward the closed position, which prevents high-pressure refrigerant from returning to the discharge chamber 19. Particularly, the specific configuration of the metal sealing surface 36 of the valve member 26 and the frusto-conical sealing surface 25 of the metal valve seat 24 leads to high contact pressure at the sealing area between the valve member 26 and the metal valve and thus to good sealing properties. Further, the metal-to-metal sealing surfaces ensure less wear and increased lifetime of the discharge check valve assembly 18.

Of course, the invention is not restricted to the embodiment described above by way of non-limiting example, but on the contrary it encompasses all embodiments thereof.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A scroll compressor comprising a compressor shell having a discharge outlet, and a discharge check valve assembly including:

a valve housing arranged at the discharge outlet of the compressor shell and being hermetically secured to the compressor shell, the valve housing including a metal valve seat, a valve member arranged within the valve housing and movable between a closed position in which the valve member bears against the metal valve seat and an open position in which the valve member is remote from the metal valve seat, wherein the valve member comprises a valve stem portion and a valve head portion connected to the valve stem portion, the valve stem portion includes a stem end portion which is remote from the valve head portion wherein the metal valve seat has a frusto-conical or toroidal sealing surface and the valve member has a metal sealing surface being formed at a radial outer portion of the valve head portion and being configured to cooperate with the frusto-conical or toroidal sealing surface when the valve member is in the closed position, the metal valve seat and the valve member being configured to define a linear sealing contact between the metal sealing surface of the valve member and the frusto-conical or toroidal sealing surface of the metal valve seat when the valve member is in the closed position, and wherein the stem end portion includes a tool fixing member configured to allow temporary fixing of a tooling, adapted to displace the valve member in the open position during assembly process of the scroll compressor, to the stem end portion.

2. The scroll compressor according to claim 1, wherein the metal sealing surface of the valve member has a spherical segment shape or is a toric surface.

3. The scroll compressor according to claim 2, wherein the metal sealing surface has a radius between 1 and 30 mm.

4. The scroll compressor according to claim 1, wherein the frusto-conical or toroidal sealing surface has a cone half-angle between 20 and 40 degrees.

5. The scroll compressor according to claim 1, wherein the discharge check valve assembly further includes a support member arranged within the valve housing and configured to support the valve member and to guide the valve member between the closed and open positions.

6. The scroll compressor according to claim 5, wherein the support member comprises a ring-shaped attachment portion fixed to the valve housing and a central support portion configured to support the valve member and to guide the valve member between the closed and open positions.

7. The scroll compressor according to claim 6, wherein the ring-shaped attachment portion and the central support portion of the support member are connected to each other by a plurality of connecting arms partially defining a plurality of flow openings for a refrigerant gas.

8. The scroll compressor according to claim 5, wherein the valve stem portion is slidably mounted on the support member.

9. The scroll compressor according to claim 6, wherein the stem end portion is configured to protrude from the central support portion when the valve member is in the closed position.

10. The scroll compressor according to claim 6, wherein the discharge check valve assembly further includes an elastic element arranged between the valve head portion of the valve member and a surface of the central support portion of the support member directed towards the valve head portion, the elastic element being configured to urge the valve member into contact with the metal valve seat, when the scroll compressor is stopped.

11. The scroll compressor according to claim 1, wherein the valve housing comprises a first tubular housing part inserted into the discharge outlet of the scroll compressor and secured to the compressor shell, the first tubular housing part having a first end portion protruding into the compressor shell and a second end portion arranged outside the compressor shell and configured to be connected to piping of a refrigeration system, a major part of the first tubular housing part extending outside the scroll compressor.

12. The scroll compressor according to claim 11, wherein the valve housing further comprises a second tubular housing part arranged inside the compressor shell, the second tubular housing part having a first end portion and a second end portion, the metal valve seat being formed adjacent the first end portion of the second tubular housing part and the second end portion of the second tubular housing cooperating with and being secured to the first end portion of the first tubular housing part at a predetermined distance from the compressor shell.

* * * * *